US005632099A

United States Patent [19]

Seifert et al.

[11] Patent Number: 5,632,099

[45] Date of Patent: May 27, 1997

[54] APPARATUS FOR DRYING FOOTWEAR

[76] Inventors: Christopher L. Seifert; Brian L. Seifert, both of 11905 Bryden Pl., Fishers, Ind. 46088-1415

[21] Appl. No.: 676,483

[22] Filed: Jul. 8, 1996

[51] Int. Cl.[6] ..... F26B 25/00

[52] U.S. Cl. ..... 34/106; D32/58

[58] Field of Search ..... 34/104, 106; D6/317; D32/58, 59

[56] References Cited

U.S. PATENT DOCUMENTS

| | | | |
|---|---|---|---|
| D. 310,742 | 9/1990 | Johnson | D32/58 |
| D. 347,094 | 5/1994 | Christensen, Jr. | D32/58 |
| D. 349,788 | 8/1994 | Laferriére et al. | D32/1 |
| 402,137 | 4/1889 | Bryant | 34/104 |
| 629,944 | 8/1899 | Witmer | 34/104 |
| 4,085,519 | 4/1978 | Masika | 34/104 |
| 4,596,078 | 6/1986 | McCartney | 34/106 X |
| 5,394,619 | 3/1995 | Kaplan | 34/104 X |

*Primary Examiner*—John M. Sollecito
*Assistant Examiner*—Steve Gravini
*Attorney, Agent, or Firm*—Jack Schuman

[57] ABSTRACT

Hot air, flowing from the register of a hot air heating system, is conducted through a piping system having vertical conduits communicating with the interior of wet or damp footwear to be dried. The tops of the vertical conduits are provided with 45° elbows to direct the hot air into the toe regions of the footwear.

5 Claims, 2 Drawing Sheets

APPARATUS FOR DRYING FOOTWEAR

BACKGROUND OF THE INVENTION

1. Field of the Invention

This invention relates, broadly speaking, to apparatus for drying wet or damp footwear.

More particularly, this invention relates to apparatus for drying wet or damp footwear from the inside, utilizing hot air flowing from conventional registers of hot air heating systems 2. Description of the Prior Art Many arrangements are known for drying wet or damp foot-wear. None are known to the inventors for drying wet or damp footwear from the inside, particularly in the toe area, utilizing hot air flowing from conventional registers of hot air heating systems.

SUMMARY OF THE INVENTION

One of the objects of this invention is to provide effective and economical apparatus for drying wet or damp footwear.

A particular object of this invention is to provide effective and economical apparatus for drying wet or damp footwear from the inside, utilizing hot air flowing from conventional registers of hot air heating systems.

Still other and further objects of this invention will become apparent by reference to the accompanying specification and drawings, and to the appended claims.

We have discovered that the foregoing objects are attained by providing a base of length and width at least equal to, and preferably greater than, the length and width of a hot air register and adapted to be seated on and cover the register. The base has a cavity in its lower surface capturing hot air from the register. A conduit extending upwardly from the cavity through the center of the base receives hot air from the register and discharges such hot air into a bifurcated piping system having two vertical conduits horizontally spaced and symmetrically disposed about the center of the base, each vertical conduit being provided at its upper end with a short length of conduit inclined to the vertical, preferably a 45° elbow. In use, each of a pair of wet or damp footwear is placed on one of the vertical conduits, the 45° elbow extending into the toe region of the footwear, so that hot air, which normally is dry or of very low humidity, from the hot air heating system, is discharged into the footwear adjacent the toe region, picking up moisture from the interior of the footwear and, carrying said moisture, exiting the footwear at the top thereof. Thus is provided an efficient, safe and economical apparatus for drying wet or damp foot-wear.

DESCRIPTION OF THE DRAWINGS

Referring now to the drawings, in which like numerals represent like parts in the several views.

DESCRIPTION OF THE PREFERRED EMBODIMENT

Figure 1:
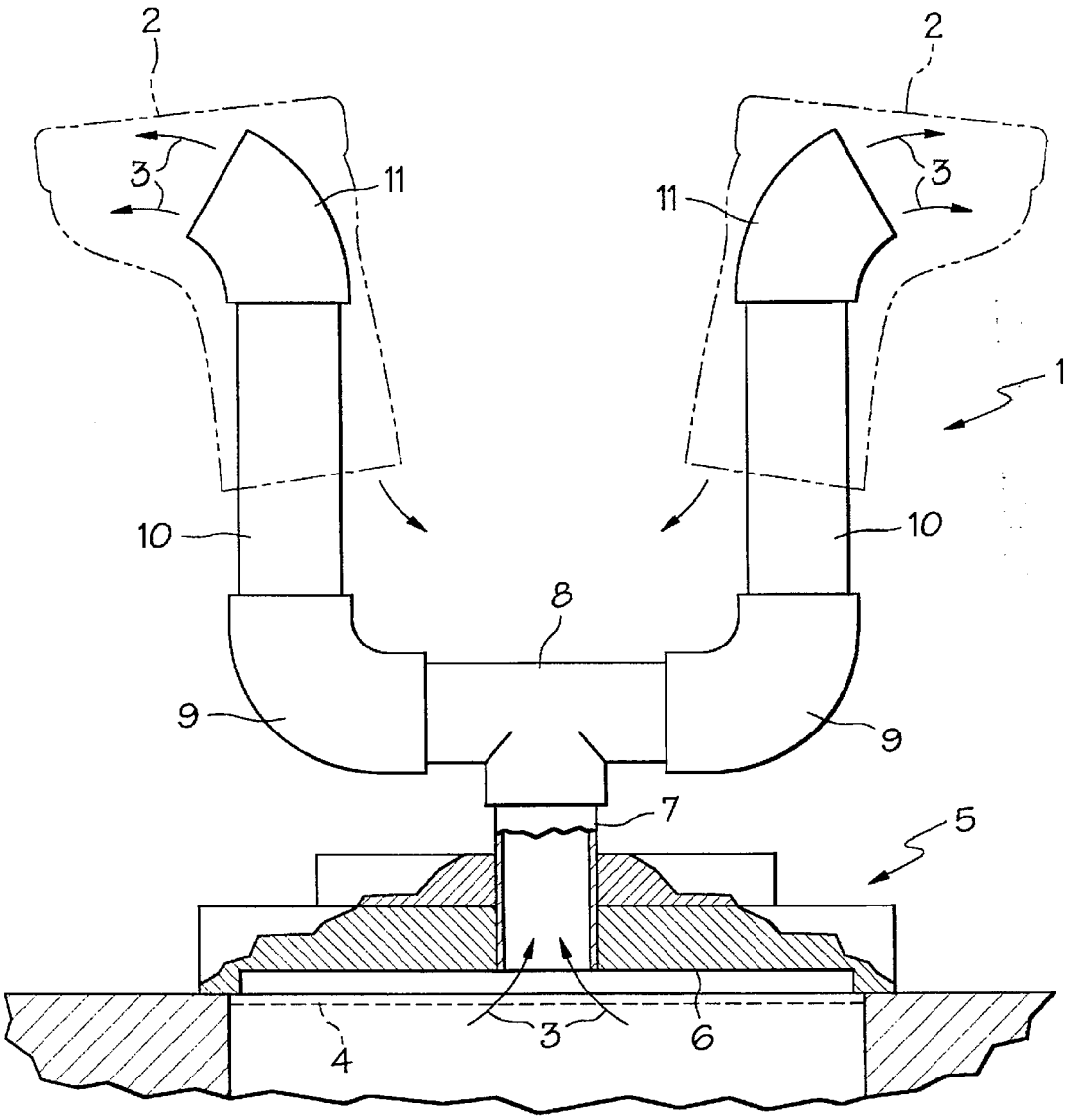
FIG. 1 represents a view in side elevation of the present invention, the base and bottom conduit of the apparatus being shown in partial medial section, the footwear to be dried being shown in phantom. Shown diagrammatically are the hot air register and the hot air flow from the register.

Apparatus 1 for drying wet or damp footwear 2 by means of hot air 3 from conventional register 4 comprises base 5 having a length and width at least equal to, and preferably slightly greater than, the length and width of register 4, so as to prevent hot air 3 flowing from register 4 escaping around the sides of base 5.

Cavity 6 is provided in the bottom of base 5, and has a length and width generally coextensive with the length and width of the open area of register 4. Thus, all of the hot air 3, which is normally dry or of very low humidity, flowing from register 4 is captured in cavity 6.

Conduit 7, extending vertically through the center of base 5 and communicating at its lower end with cavity 6, is connected at its upper end with the branch or side opening of tee 8. Each end opening or run of tee 8 is connected to one end of a 90° elbow 9, the other end of each 90° elbow being connected to the lower end of a vertical conduit 10. The upper end of each vertical conduit 10 is connected to a 45° elbow 11.

At this point, it will be noted that vertical conduits 10 are equispaced from the longitudinal axis of conduit 7, which itself is centered in base 5. This symmetrical arrangement provides stability to apparatus 1 which is desirable, particularly when large heavy footwear 2 is to be dried. An extra degree of stability may be attained by making base 5 and conduit 7 of heavy material, for example cast or wrought iron.

In operation, base 5 is placed over register 4 so that cavity 6 covers the entire open area of register 4. Wet or damp footwear 2 to be dried is placed over the upper ends of vertical conduits 10 so that 45° elbows 11 extend to the toe regions of said footwear 2.

Hot air 3, which normally is dry or of very low humidity, from register 4 flows into cavity 6, thence through conduit 7, through tee 8, up through vertical conduits 10, and out through 45° elbows 11 into the toe regions of footwear 2. Hot air 3, carrying with it moisture from the interior of the wet or damp footwear 2, flows out from the tops of footwear 2, as indicated diagrammatically in FIG. 1. This flow of hot air 3 through the interior of footwear effectively, safely, efficiently and economically dries footwear 2, particularly the hitherto difficult-to-dry toe region.

Figure 2:
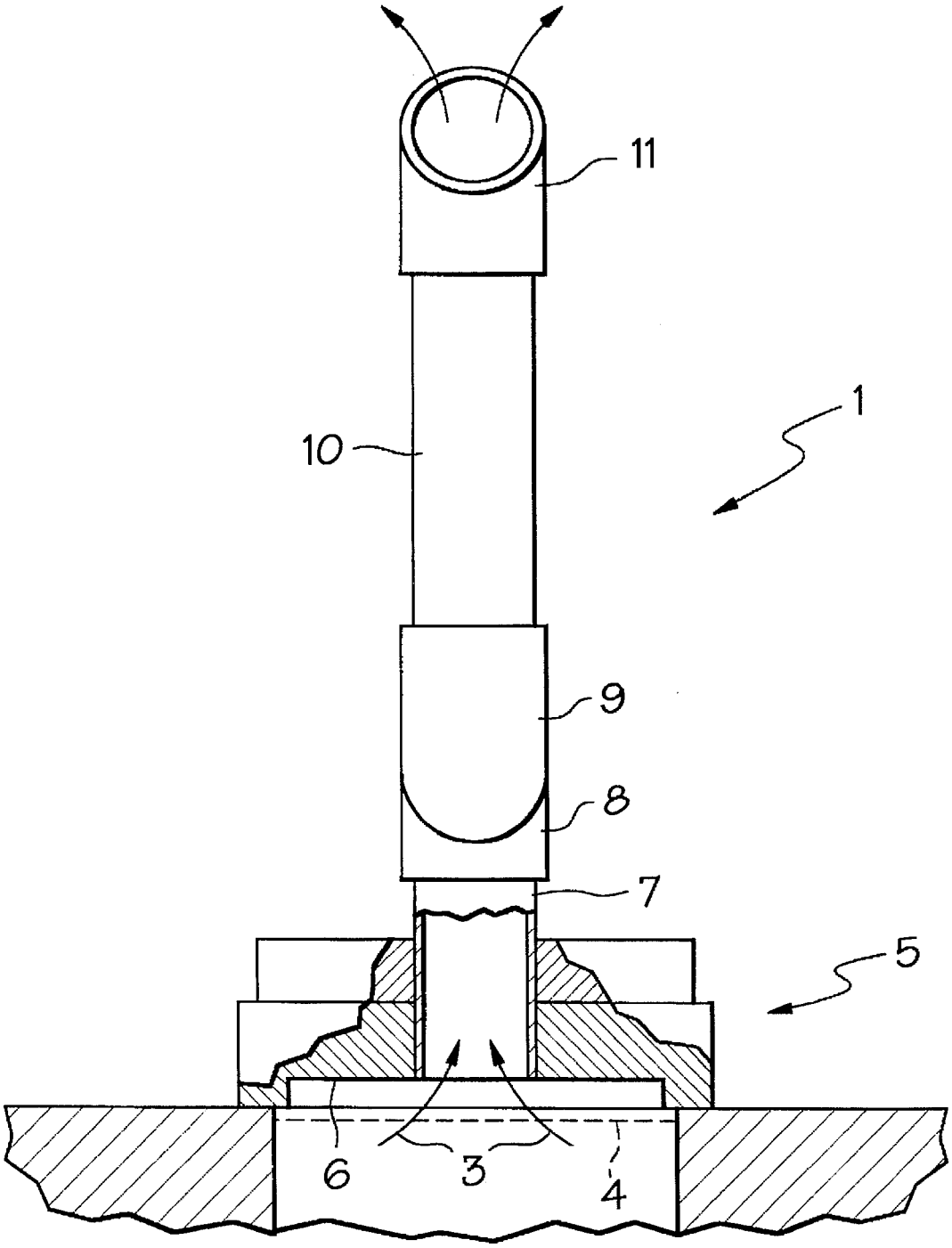
FIG. 2 represents a view in end elevation of the present invention, the base and bottom conduit of the apparatus being shown in partial medial section. Shown diagrammatically are the hot air register and the hot air flowing from the register.

In the preferred embodiment, 45° elbows 11 are secured to the tops of vertical conduits 10 in such orientation that they lie in the same plane as the rest of apparatus 1, as shown in FIG. 2. This orientation will, in most instances, suffice to maintain footwear 2 away from wall surfaces when registers 4 are positioned adjacent the bottom of a wall.

Alternatively, 45° elbows 11 may be rotatably mounted on the upper ends of vertical conduits 10, so that for oversize footwear 2, the said 45° elbows 11 may be rotated away from the wall adjacent to the register 4 so as to provide clearance between the footwear 2 and the wall.

It will be seen, from the foregoing, that we have invented a useful apparatus for effectively, safely, efficiently and economically drying wet or damp footwear, particularly the interior toe region.

Since modifications and changes which do not depart from the spirit of the invention as disclosed herein may readily occur to those skilled in the art to which this invention pertains, the appended claims should be construed as covering suitable modifications and equivalents.

We claim:

1. Apparatus (1) for drying footwear (2) by means of hot air (3) flowing from a hot air register (4) of a hot air heating system, said hot air register (4) having a frame forming the perimeter of an open area through which said hot air (3) flows, said apparatus (1) comprising:

(a) a base (5) covering the entire frame of said hot air register (4), (b) a cavity (6) in the bottom surface of said base (5), said cavity (6) being generally coextensive with the open area of said hot air register (4) thereby capturing all hot air (3) flowing through the open area of said hot air register (4), (c) a main conduit (7) communicating at its lower end with said cavity (6), said main conduit (7) extending upwardly through the center of said base (5), the upper end of said main conduit (7) extending above said base (5), (d) first and second conduits (10) communicating with the upper end of said main conduit (7) and extending upwardly therefrom, said first and second conduits (10) being horizontally equispaced from the center of said base (5), (e) first and second curved conduits (11), the lower ends of said curved conduits (11) communicating with the upper ends of said first and second conduits (10) and adapted to extend into the toe regions of footwear (2) to be dried when said footwear (2) is placed over said first and second curved conduits (11) and said first and second conduits (10), (f) whereby only hot air (3) flowing through the open area of said hot air register (4) is conducted through said main conduit (7), said first and second conduits (10) and said first and second curved conduits (11) to the interior of said footwear (2) including the toe regions of said footwear (2), (g) whereby hot air (3) carrying with it moisture from the interior of said footwear (2) flows out of said footwear (2) through the annular spaces between said first and second vertical conduits (10) and the tops of said footwear (2), (h) whereby the apparatus (1) is balanced about the center of said base (5).

2. Apparatus as in claim 1, wherein said first and second curved conduits (11) are 45° elbows.

3. Apparatus as in claim 1, wherein said first and second curved conduits (11) are mounted to the upper ends of said first and second conduits (10) in such manner that they are directed away from each other.

4. Apparatus as in claim 1, wherein said first and second curved conduits (11) are rotatably mounted to the upper ends of said first and second conduits (10).

5. Apparatus as in claim 1, wherein said main conduit (7), said first and second conduits (10) and said first and second curved conduits (11) lie in the same plane.

* * * * *